US005664677A

United States Patent [19]

O'Connor

[11] Patent Number: 5,664,677

[45] Date of Patent: Sep. 9, 1997

[54] PRESATURATED WIPER ASSEMBLY

[75] Inventor: Kenneth J. O'Connor, Spartanburg, S.C.

[73] Assignee: Contec, Inc. of Spartanburg, Spartanburg, S.C.

[21] Appl. No.: 756,705

[22] Filed: Nov. 26, 1996

Related U.S. Application Data

[63] Continuation of Ser. No. 486,308, Jun. 7, 1995, abandoned.

[51] Int. Cl.[6] ..... B65D 81/24

[52] U.S. Cl. ..... 206/494; 206/812

[58] Field of Search ..... 206/484, 494, 206/233, 812, 484.2; 383/59, 86

[56] References Cited

U.S. PATENT DOCUMENTS

| | | | |
|---|---|---|---|
| 3,396,901 | 8/1968 | McFedries, Jr. | 206/484 |
| 4,420,080 | 12/1983 | Nakamura | 206/449 |
| 4,557,381 | 12/1985 | Whitney | 206/812 X |
| 4,679,693 | 7/1987 | Forman . | |
| 4,790,436 | 12/1988 | Nakamura | 206/494 X |
| 4,840,270 | 6/1989 | Caputo et al. | 206/205 |
| 4,848,575 | 7/1989 | Nakamura et al. | 206/494 X |
| 4,863,064 | 9/1989 | Dailey, III | 206/494 X |
| 5,048,718 | 9/1991 | Nakamura | 206/233 X |
| 5,145,091 | 9/1992 | Meyers | 206/494 X |
| 5,344,007 | 9/1994 | Nakamura et al. | 206/205 |
| 5,409,116 | 4/1995 | Aronsen | 206/494 X |

FOREIGN PATENT DOCUMENTS

| | | |
|---|---|---|
| 0488967A1 | 6/1992 | European Pat. Off. . |
| 648475 | 2/1994 | Japan . |

*Primary Examiner*—Jacob K. Ackun
*Attorney, Agent, or Firm*—Dority & Manning

[57] ABSTRACT

A wiper assembly for use in cleansing a controlled environment. The assembly comprises a generally flat container having therein a plurality of wiper cloths presaturated with a selected cleaning or disinfectant solvent. A top portion of the container defines an opening for wiper cloth removal which may be selectively opened and closed using a flexible adhesive panel. The bottom portion of the container is characterized by a greater rigidity than the rigidity of the top portion. This enhanced rigidity is sufficient to substantially prevent bending of the container during removal of the wiper cloths and closure of the container opening.

20 Claims, 6 Drawing Sheets

PRESATURATED WIPER ASSEMBLY

This is a continuation of application Ser. No. 08/486,308, filed Jun. 7, 1995, which was abandoned upon the filing hereof.

BACKGROUND OF THE INVENTION

The present invention relates to packaged wipers of the type which are presaturated with a selected cleaning or disinfectant solution for cleansing a controlled environment, such as a medical facility or an industrial cleanroom.

Presaturated wipers for cleansing controlled environments have been provided in various package configurations. In one such configuration, a relatively flat container is formed of two like pieces of polymeric web material. The two pieces of material are juxtaposed to one another and joined by heat bonding about their periphery to form an interior cavity. A foldable flap is cut into one of the pieces of material to define a container opening for access to the interior cavity. A plurality of wiper cloths, saturated with the desired cleaning or disinfectant solution, are placed into the interior cavity of the container. As used herein, it is to be understood that the term "wiper cloth" refers to any suitable woven or nonwoven sheet material, whether or not the material is a textile product.

An adhesive label is situated over the foldable flap to allow selective closure of the container opening. The package may thus be opened by "peeling back" the adhesive label. An individual wiper cloth can then be removed from the package for use in cleansing a controlled environment, as desired. The package is closed by covering the container opening with the adhesive label.

In the prior art package discussed above, the top and bottom portions of the container are both formed of the same polymeric web material. This material is relatively thin, generally having a thickness of approximately 0.005 inches. As a result, the container itself tends to be relatively flexible. The flexibility of the package contributes, at least in part, to dispersion of the cleaning solution during transit. Specifically, loading of the packages in a stack for transit tends to squeeze the wiper cloths together, thus causing a relatively even dispersion of the cleaning solution.

When the number of wiper cloths in the container has not been substantially depleted, the stack of wiper cloths tends to maintain the package in a relatively rigid state. In this rigid state, the package tends to resist bending or flexing as it is opened or closed. Additionally, the package tends to remain relatively rigid as an individual wiper cloth is removed from the container opening.

When few wiper cloths remain in the package, however, they no longer substantially contribute to package rigidity. As a result, the container will tend to be pulled into a bent configuration as the adhesive label is peeled back. The container also tends to bend as individual wiper cloths are removed. Due to this bending, the package itself will become somewhat crumpled during use, thus resulting in a less than desirable seal as the adhesive label is placed over the container opening.

SUMMARY OF THE INVENTION

The present invention recognizes and addresses the foregoing disadvantages, and others, of prior art constructions and methods.

Accordingly, it is an object of the present invention to provide an improved presaturated wiper assembly.

It is another object of the present invention to provide an improved presaturated wiper assembly including a container that remains relatively rigid despite depletion of the wiper cloths.

It is a further object of the present invention to provide an improved presaturated wiper assembly including a container which facilitates dispersion of the solution during transit.

These and other objects of the present invention are achieved by a presaturated wiper assembly for use in cleansing a controlled environment. The assembly comprises a substantially flat container having a top portion and a bottom portion each constructed of a polymeric sheet material. An interior cavity is defined in the container between the top portion and the bottom portion. The top portion further defines a container opening for access to the interior cavity having a plurality of wiper cloths located therein. A selected cleaning solution is further located in the interior cavity in a sufficient quantity to substantially saturate the wiper cloths.

The assembly further includes a panel having a pivot portion secured to the top portion of the container and a foldable closure portion extending therefrom. The closure portion of the panel removably engages the top portion of the container to permit selective closure of the container opening. In an exemplary construction, the top portion includes a foldable flap secured to and underlying the closure portion of the panel. In this case, the top portion of the container is engaged by an overlapping region of the closure portion having adhesive thereon.

The bottom portion of the container is characterized by a first rigidity greater than a second rigidity of the top portion. The first rigidity of the bottom portion comprises a rigidity means sufficient to substantially prevent bending of the container during removal of the wiper cloths and closure of the container opening. Toward this end, the first rigidity of the bottom portion may be characterized by a flexural modulus falling within a range of approximately 200,000 to 500,000 pounds per square inch (psi). In an exemplary construction, the first rigidity may be characterized by a nominal flexural modulus of approximately 375,000 psi.

The top portion of the container may have a thickness of less than approximately 0.006 inches. To provide enhanced rigidity, the bottom portion of the container has a thickness of at least approximately 0.008 inches in this case. In an exemplary embodiment, the thickness of the bottom portion is approximately 0.018 inches.

The bottom portion may be constructed of a composite polymeric material having a first layer of vinyl and a second layer of polyethylene. In this case, vinyl layer is preferably situated on the outside of the container, with the polyethylene layer being on the inside. In an exemplary construction, the vinyl layer may have a thickness of approximately 0.016 inches and the second layer may have a thickness of approximately 0.02 inches, yielding a total thickness of 0.018 inches.

In another presently preferred embodiment, the bottom portion is constructed of a composite polymeric material having a stripe portion and a pair of side portions. The stripe portion has a greater characteristic rigidity than the side portions, giving the overall bottom portion the first rigidity as described above. The stripe portion preferably extends longitudinally in an elongated direction of the container.

In a still further presently preferred embodiment, the bottom portion may be configured as a formed tray.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
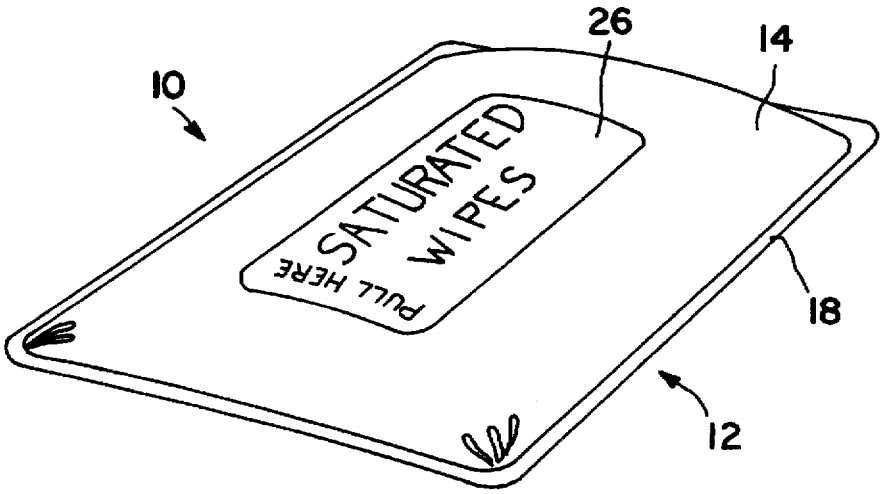
FIG. 1 is a perspective view of an improved presaturated wiper assembly of the present invention.

Repeat use of reference characters in the present specification and drawings is intended to represent same or analogous features or elements of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Figure 2:
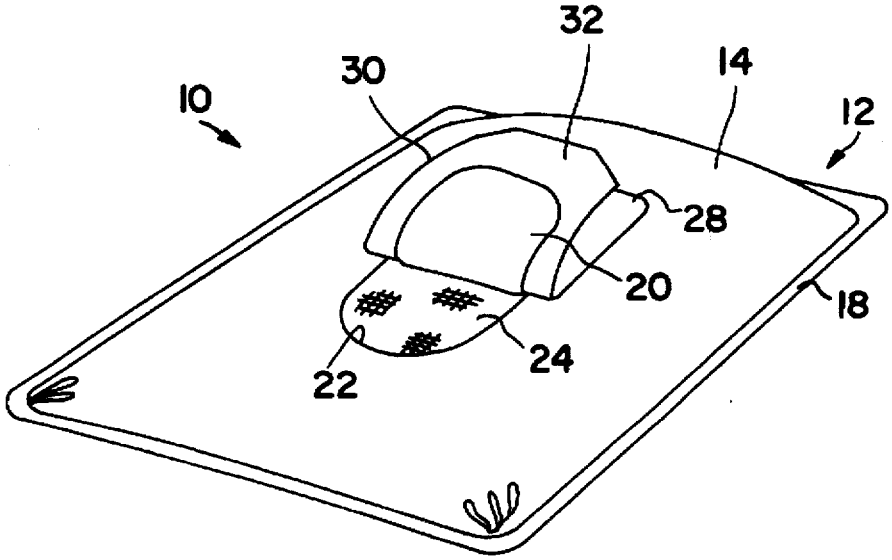
FIG. 2 is a view similar to FIG. 1 in which the container of the wiper assembly is partially open.
Figure 3:
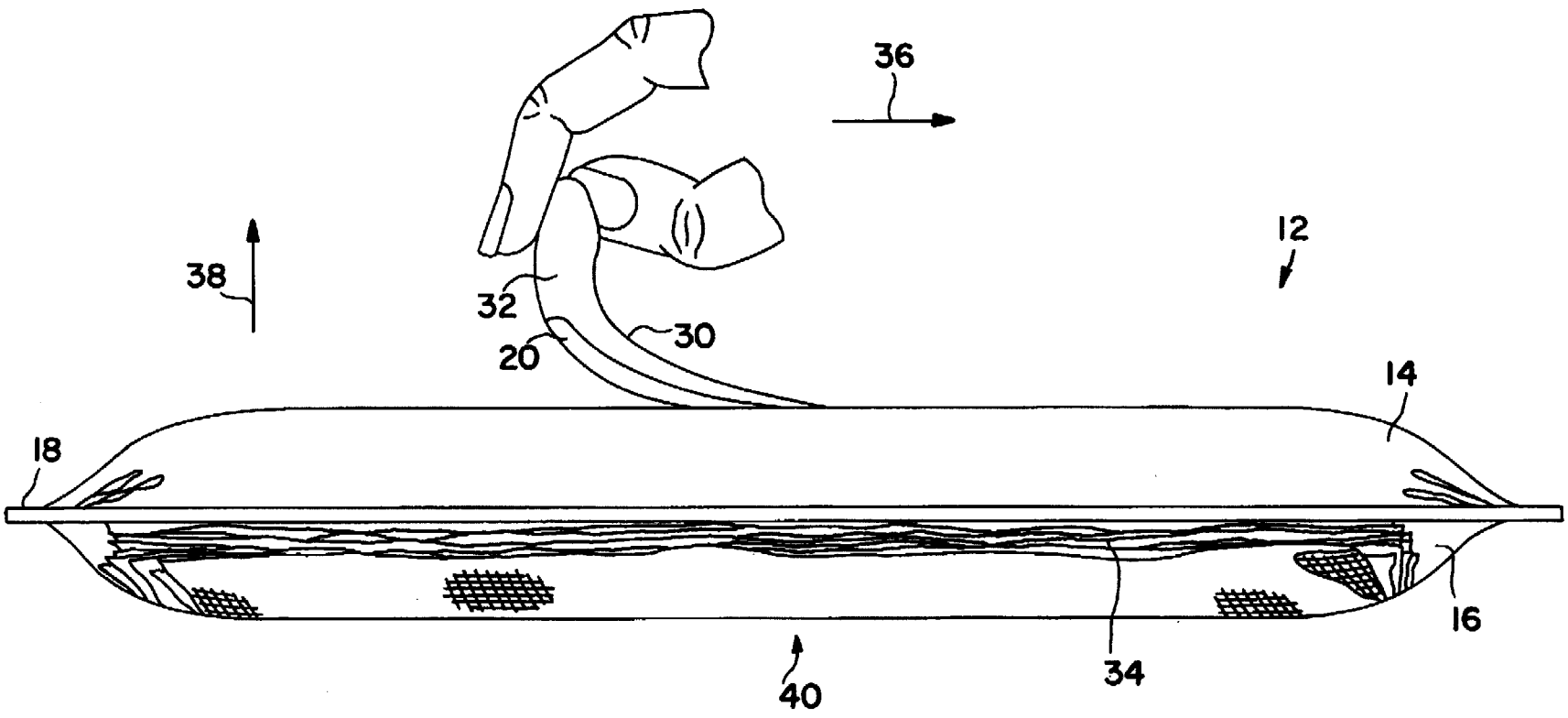
FIG. 3 is a side elevation of the improved presaturated wiper assembly shown in FIG. 1 illustrating the manner in which the container may be opened by a user.

A presaturated wiper assembly 10 constructed in accordance with the present invention is illustrated in FIGS. 1 and 2. Wiper assembly 10 includes a generally flat container 12 having a top portion 14 and a bottom portion 16 (FIG. 3). Top portion 14 and bottom portion 16 are constructed of polymeric sheet material having differing respective rigidity characteristics as will be explained more fully below. A heat bond 18 is formed about the periphery of container 12 to join top portion 14 and bottom portion 16 together, as shown.

As shown in FIG. 2, a foldable flap 20, which may be generally tongue shaped, is cut into top portion 14 to define a container opening, as indicated at 22. When flap 20 is "peeled back," opening 22 is exposed to allow individual wiper cloths, such as that shown at 24, to be removed. The wiper cloths are saturated with a selected cleaning or disinfectant solvent as may be suitable for a particular application.

For closure, flap 20 is placed in position substantially coplanar with the remainder of top portion 14. Flap 20 is maintained in this position, and opening 22 is sealed shut, by a panel 26 which may also serve as an informational label.

Panel 26 includes a pivot portion 28 and a closure portion 30, as shown. Pivot portion 28 normally remains secured to top portion 14 during use. Closure portion 30, on the other hand, removably engages top portion 14 to permit selective closure of opening 22. In this regard, closure portion 30 includes an overlapping region 32 extending from the periphery of flap 20. The bottom side of overlapping region 32 has an adhesive thereon which sticks to top portion 14, but not so tightly that it cannot be peeled back when desired.

Referring now to FIG. 3, bottom portion 16 may be more easily seen. In this case, bottom portion 16 is transparent, whereas top portion 14 is opaque. It should be appreciated, however, that bottom portion 16 may also be opaque, if desired. Because bottom portion 16 is transparent in this case, a stack 34 of wiper cloths may be seen inside of container 12.

The prior art package discussed above achieved much of its rigidity from the stack of wiper cloths located therein. As a result, when the number of wiper cloths in the stack became relatively low, the package became susceptible to excessive flexing or bending. This bending resulted in greater difficulty being required to remove wiper cloths from the package, as well as during opening or closing of the package for wiper cloth removal.

The present invention overcomes the noted deficiencies in the prior art by constructing container 12 such that top portion 14 and bottom portion 16 have differing rigidity characteristics. Specifically, top portion 14 has relatively low rigidity so that flap 20 will be relatively easy to fold and unfold. Additionally, a relatively low rigidity in top portion 14 facilitates dispersion of the solvent solution when a multiplicity of wiper assemblies such as assembly 10 are stacked and shipped. Bottom portion 16, on the other hand, is constructed to have a greater rigidity than top portion 14. Thus, container 12 will tend to remain substantially flat during use.

As an illustration, consider the process of opening container 12, as shown in FIG. 3. In this case, the closure portion 30 of panel 26 is gripped between the thumb and forefinger of a user. The user then pulls closure portion 30 in the direction shown by arrow 36 to expose the container opening. This pulling by the user imparts a bending force to container 12, as represented by the arrow 38. With a low rigidity package, the bending force may cause the package to bend generally about the area indicated at 40. The rigidity of bottom portion 16, however, is chosen to resist this bending. Thus, container 12 remains substantially flat as container 12 is opened.

Figure 4:
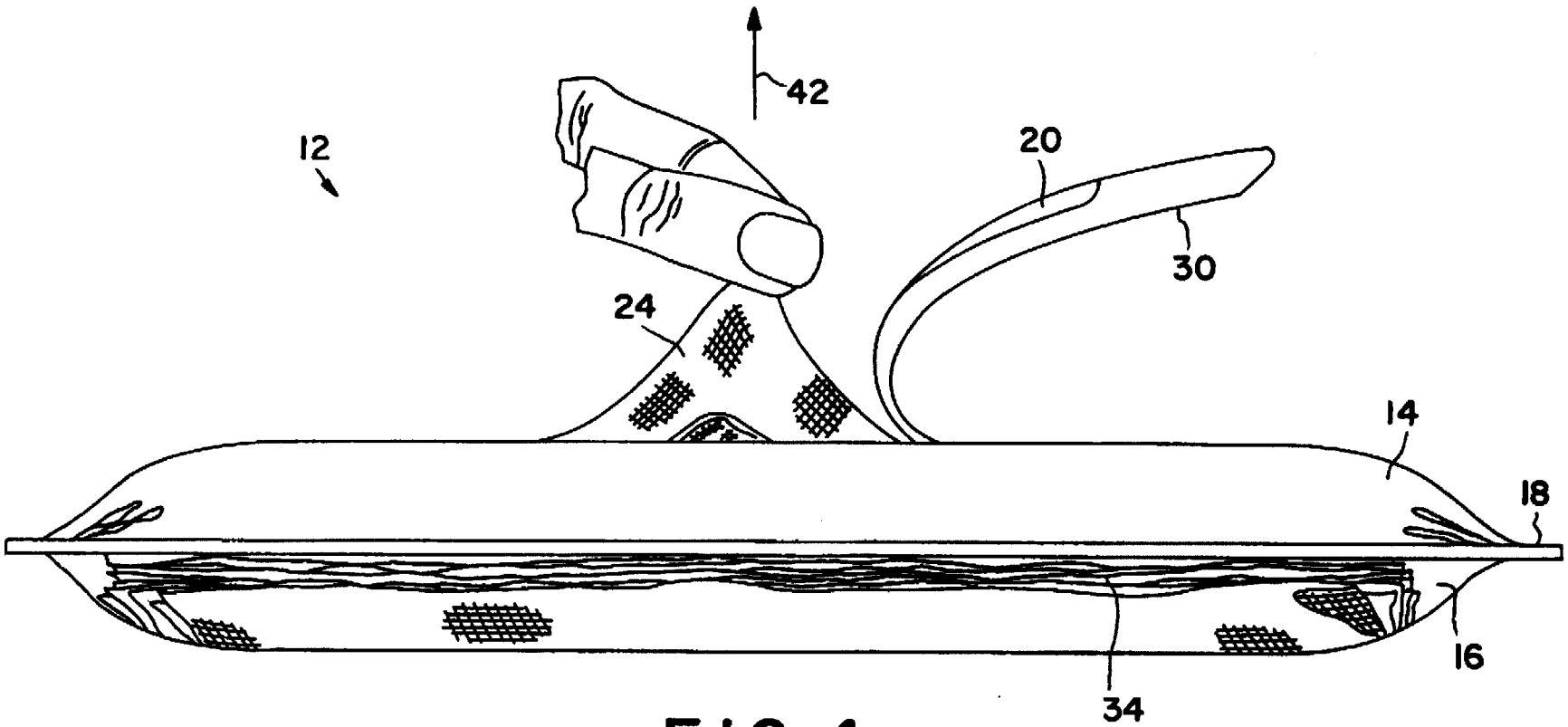
FIG. 4 is a view similar to FIG. 3 illustrating the manner in which an individual wiper cloth may be removed from the container.

Referring now to FIG. 4, the user is shown removing wiper cloth 24. Because wiper cloth 24 is larger than the container opening, its removal tends to impart an upward force on the center portion of the package, as indicated by arrow 42. If container 12 was susceptible to bending as in the prior art, this upward force could cause it to resemble an inverted "V." It will be appreciated that removal of wiper cloth would be relatively difficult with the package bent in this manner. Due to the rigidity contributed by bottom portion 16, however, container 12 remains substantially flat as wiper cloth 24 is removed.

Figure 5:
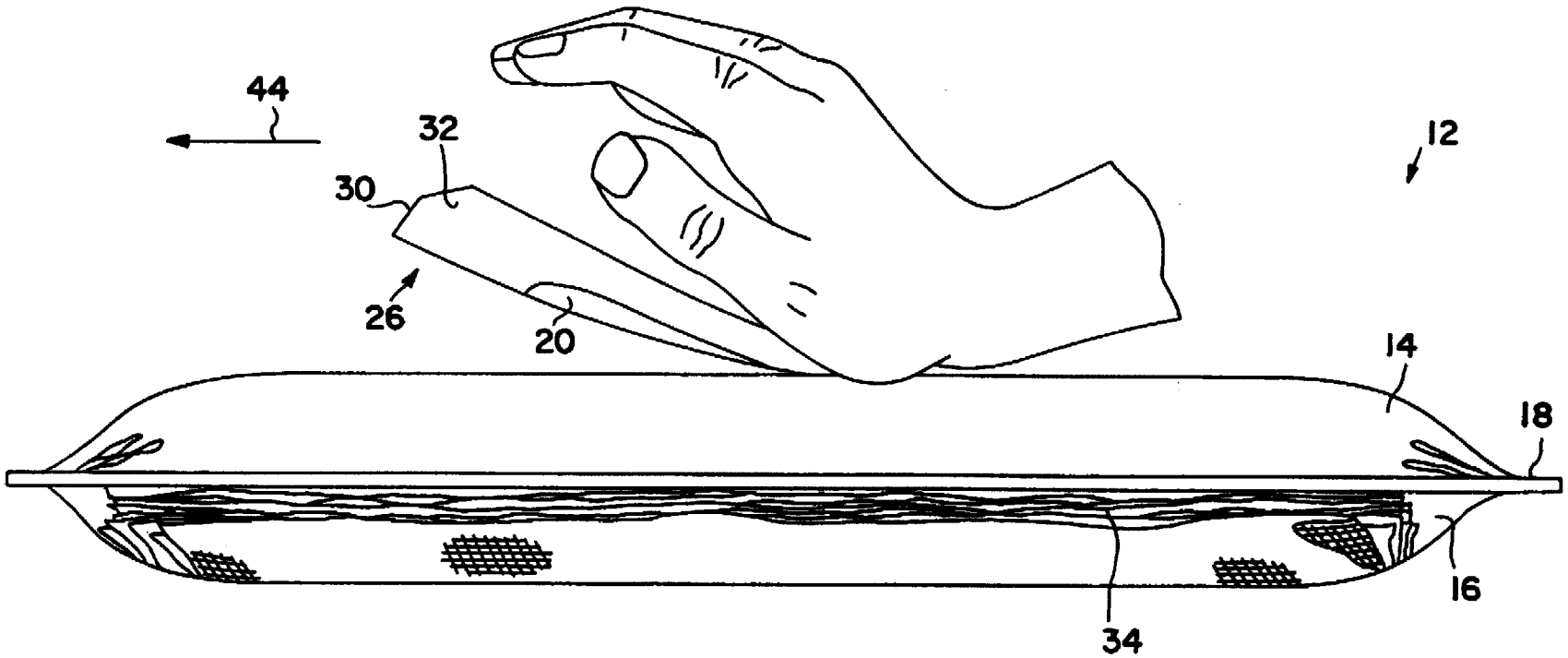
FIG. 5 is a view similar to FIGS. 3 and 4 illustrating the manner in which the container may be closed.

After wiper cloth 24 is removed, container 12 may be closed as shown in FIG. 5. In this example, flap 20 is folded back into the closed position by the palm of the user's hand, which is moving in a direction as indicated by arrow 44. This technique tends to "iron out" ripples in top portion 14, thus causing a relatively secure seal to be achieved between panel 26 and top portion 14.

It will be appreciated that continual bending of container 12, as is generally prevented by the present invention, would cause top portion 14 to become somewhat crumpled over time. The various wrinkles thus developed may reduce the degree to which a secure seal could be achieved between top portion 14 and panel 26. Because of the rigidity contributed by bottom portion 16, many bend wrinkles which may otherwise occur in top portion 14 may thus be prevented.

In presently preferred embodiments, top layer 14 is constructed of a composite material having a layer of polyethylene adhered to a layer of polyester. The polyester layer is preferably situated on the outside of container 12, with the polyethylene being situated on the inside. As with the prior art, top portion 14 preferably has a thickness of not greater than approximately 0.006 inches.

Figure 6:
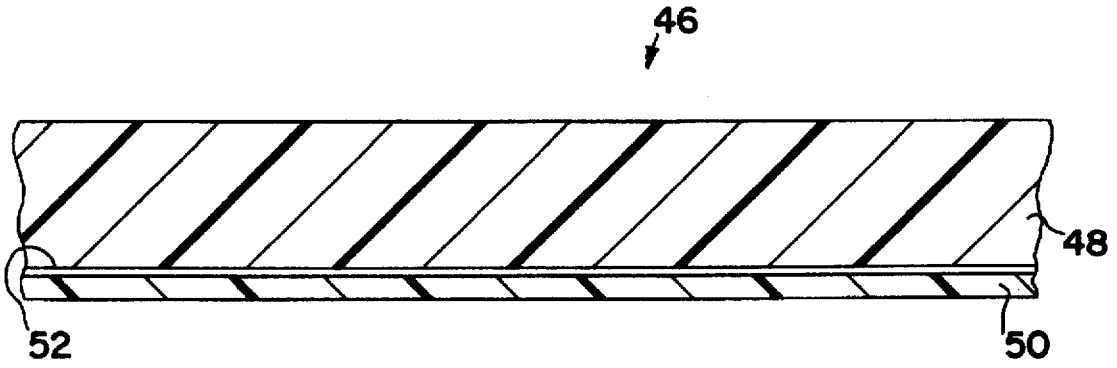
FIG. 6 is a cross-sectional view of one presently preferred material from which the bottom portion of the container may be constructed.

FIG. 6 illustrates a preferred material 46 from which bottom portion 16 may be constructed. As shown, material 46 is a composite having a first layer 48 adhered to a second layer 50. Layer 50, which is preferably on the inside of container 12, may be polyethylene or another material heat-bondable to polyethylene when such comprises the inside surface of top portion 14. In this manner, the polyethylene layer of top portion 14 and the polyethylene layer of bottom portion 16 will bond together at heat bond 18. First layer 48 and second layer 50 are adhered together by an adhesive layer, as indicated at 52. It should also be appreciated that appropriate single layer materials may also be utilized for bottom portion 16.

In the case of polymeric sheet materials as described, sufficient rigidity is generally achieved if the material has a thickness of greater than 0.008 inches. In an exemplary construction, the thickness of the material is approximately 0.018 inches. For composite material 46, this may be achieved by constructing first layer 48 to have a thickness of approximately 0.016 inches and second layer 50 to have a thickness of approximately 0.002 inches.

Sufficient rigidity may also be expressed by the flexural modulus, measured per the ASTM D-790 method or equivalent. In this case, adequate rigidity may be achieved with a flexural modulus of greater than approximately 200,000 psi. In presently preferred embodiments, the flexural modulus would generally not exceed 500,000 psi, with an exemplary construction exhibiting a nominal flexural modulus of approximately 375,000 psi.

Figure 7:
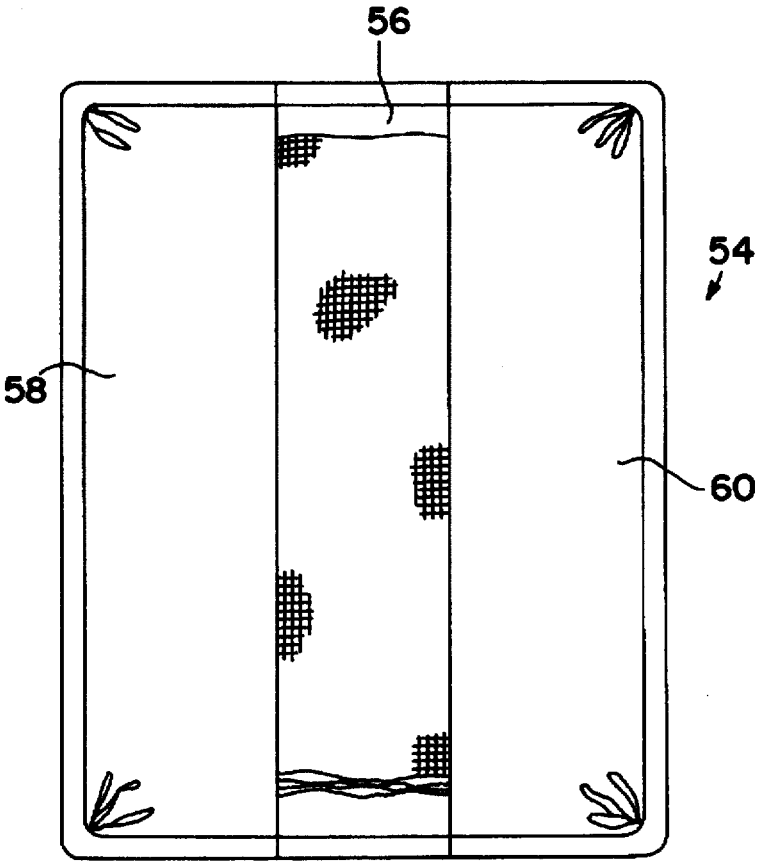
FIG. 7 is a bottom plan view of a first alternative construction of the bottom portion of the container.

In addition to the continuous webs discussed above, the invention contemplates various other configurations of the container bottom portion which may also achieve the desired rigidity. For example, FIG. 7 illustrates a container bottom portion 54 having a stripe portion 56 extending in the elongated direction of the container. A pair of side portions 58 and 60 are located adjacent stripe portion 56 as shown.

In this case, side portions 58 and 60 are constructed of a relatively thin sheet material, such as top portion 14 of container 12. On the other hand, stripe portion 56 is constructed relatively thick to have greater rigidity. As a result, the overall rigidity of bottom portion 54 will be increased. In this case, side portions 58 and 60 are opaque, whereas stripe portion 60 is transparent.

Figure 8:
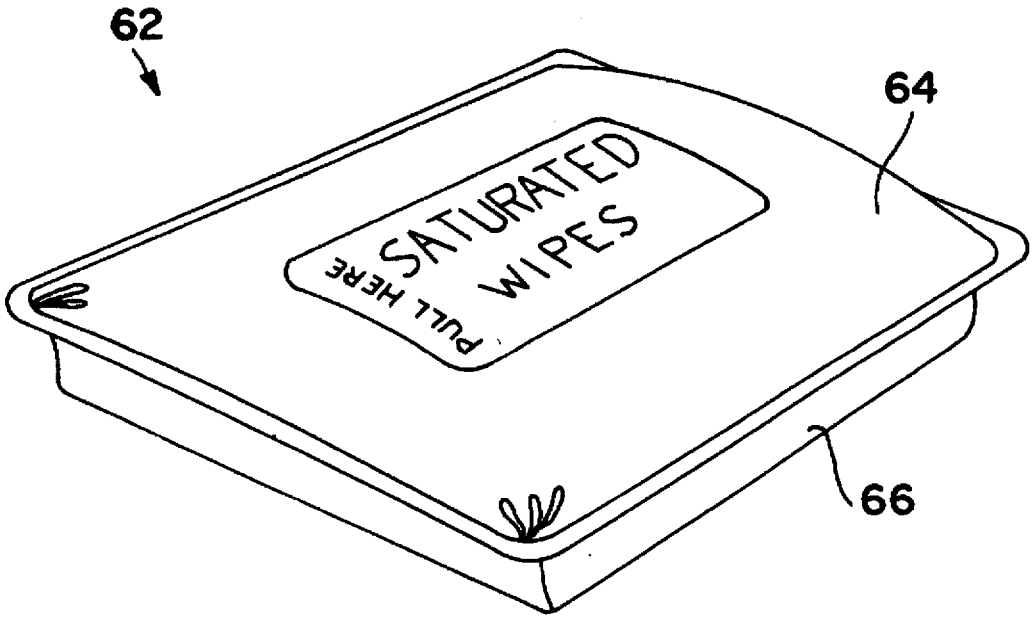
FIG. 8 is a perspective view of a second alternative construction of the bottom portion of the container.
Figure 9:
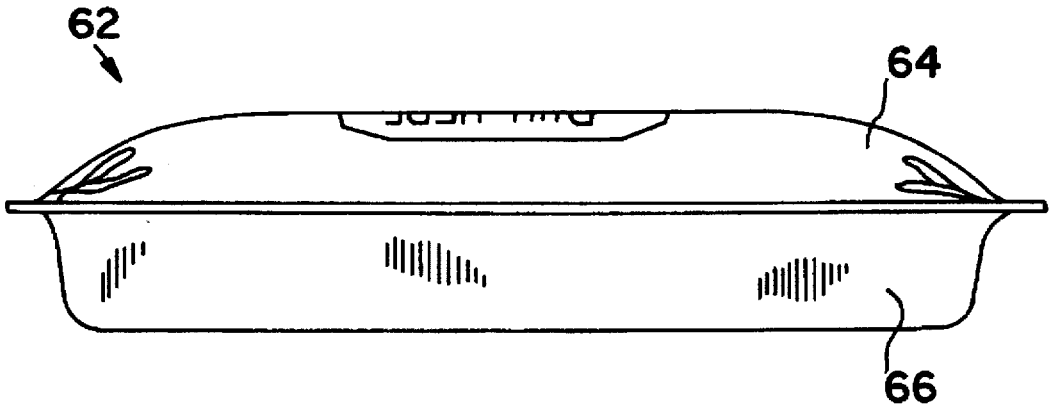
FIG. 9 is an end elevational view of the wiper assembly of FIG. 8.

FIGS. 8 and 9 illustrate a still further embodiment of the present invention. Specifically, a container 62 is illustrated having a top portion 64 as described which is joined to a thermoformed tray 66. The rigidity of thermoformed tray 66 contributes stiffness to container 62 in a manner similar to the packages discussed above.

While preferred embodiments of the invention have been shown and described, modifications and variations thereto may be practiced by those of ordinary skill in the art without departing from the spirit and scope of the present invention, which is more particularly set forth in the appended claims. For example, a rigid member may be inserted into an otherwise flexible package below a stack of wiper cloths. Such a rigid member would preferably be configured to engage the package to provide the characteristic rigidity to the overall assembly as described above.

In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A presaturated wiper assembly for use in cleansing a controlled environment, said assembly comprising:

a generally flat container having a top portion and a bottom portion each comprising a polymeric sheet, said top portion disposed on an opposite side from said bottom portion of a plane substantially including a circumference of said container at which said top portion meets said bottom portion to define an interior cavity between said top portion and said bottom portion;

said top portion further defining a container opening for access to said interior cavity;

a panel having a pivot portion secured to said top portion and a foldable closure portion extending therefrom, said closure portion removably engaging said top portion to permit selective closure of said container opening;

a plurality of wiper cloths located in said interior cavity and forming a stack, said stack deforming said top portion and said bottom portion respectively away from said plane;

cleaning solution located in said interior cavity to substantially saturate said plurality of wiper cloths; and one of said bottom portion and said top portion having a first rigidity greater than a second rigidity of the other of said top portion and said bottom portion, said first rigidity being sufficient to substantially prevent bending of said container during removal of said wiper cloths and closure of said container opening.

2. A presaturated wiper assembly as set forth in claim 1, wherein said bottom portion has said first rigidity and said top portion has said second rigidity.

3. A presaturated wiper assembly as set forth in claim 2, wherein said top portion includes a foldable flap secured to and underlying said closure portion of said panel, an overlapping region of said closure portion having adhesive thereon for engaging said top portion.

4. A presaturated wiper assembly as set forth in claim 3, wherein said top portion of said container has a thickness of less than approximately 0.006 inches and said bottom portion of said container has a thickness of at least approximately 0.008 inches.

5. A presaturated wiper assembly as set forth in claim 3, wherein said first rigidity of said bottom portion is characterized by a flexural modulus falling within a range of approximately 200,000 to 500,000 psi.

6. A presaturated wiper assembly as set forth in claim 3, wherein said first rigidity of said bottom portion is characterized by a nominal flexural modulus of approximately 375,000 psi.

7. A presaturated wiper assembly as set forth in claim 3, wherein said top portion of said container has a thickness of less than approximately 0.006 inches and wherein said bottom portion of said container has a thickness of approximately 0.018 inches.

8. A presaturated wiper assembly as set forth in claim 3, wherein said bottom portion is constructed of a composite polymeric material having a first layer of vinyl and a second layer of polyethylene.

9. A presaturated wiper assembly as set forth in claim 8, wherein said first layer has a thickness of approximately 0.016 inches and said second layer has a thickness of approximately 0.002 inches.

10. A presaturated wiper assembly as set forth in claim 3, wherein said bottom portion is constructed of a composite polymeric material having a stripe portion and a pair of side portions, said stripe portion having a greater characteristic rigidity than said side portions.

11. A presaturated wiper assembly as set forth in claim 10, wherein said stripe portion extends longitudinally in an elongated direction of said container.

12. A presaturated wiper assembly as set forth in claim 2, wherein said rigidity of said bottom portion is characterized by a flexural modulus falling within a range of approximately 200,000 to 500,000 psi.

13. A presaturated wiper assembly as set forth in claim 2, wherein said rigidity of said bottom portion is characterized by a nominal flexural modulus of approximately 375,000 psi.

14. A presaturated wiper assembly for use in cleansing a controlled environment, said assembly comprising:

a generally flat container having a top portion and a bottom portion each comprising a polymeric sheet, said top portion disposed on an opposite side from said bottom portion of a plane substantially including a circumference of said container at which said top portion meets said bottom portion to form an interior cavity between said top portion and said bottom portion;

said top portion including a foldable flap to define a container opening for access to said interior cavity;

a panel having a pivot portion secured to said top portion and a foldable closure portion overlying said flap, said closure portion having an adhesive area for removably engaging said top portion;

a wiper cloth stack located in said interior cavity and deforming said top portion and said bottom portion respectively away from said plane;

cleaning solution located in said interior cavity to substantially saturate wiper cloths in said wiper cloth stack; and said container also including a rigidity mechanism associated with at least one of said top portion and said bottom portion, said rigidity mechanism configured to substantially prevent bending of said container during removal of said wiper cloths and closure of said container opening, even if said wiper cloth stack is substantially depleted.

15. A presaturated wiper assembly as set forth in claim 14, wherein said rigidity means comprises said bottom portion of said container.

16. A presaturated wiper assembly as set forth in claim 15, wherein said bottom portion of said container has a thickness of at least approximately 0.008 inches.

17. A presaturated wiper assembly as set forth in claim 15, wherein said bottom portion of said container has a thickness of approximately 0.018 inches.

18. A presaturated wiper assembly as set forth in claim 15, wherein said bottom portion of said container is characterized by a flexural modulus falling within a range of approximately 200,000 to 500,000 psi.

19. A presaturated wiper assembly as set forth in claim 14, wherein each of said top portion and said bottom portion is comprised of a polymeric sheet separate from the polymeric sheet comprising the other of said top portion and said bottom portion.

20. A presaturated wiper assembly as set forth in claim 19, wherein said separate polymeric sheets respectively comprising said top portion and said bottom portion are attached to each other substantially along said circumference.

* * * * *